US006110005A

United States Patent [19]

Stephenson et al.

[11] Patent Number: 6,110,005

[45] Date of Patent: Aug. 29, 2000

[54] SPORTS BRA

[76] Inventors: Steve C. Stephenson, 860 S. Creekwood Dr., Fairview, Tex. 75069; Michael D. Draper, 606 S. Waco St., Weatherford, Tex. 76086

[21] Appl. No.: 09/262,622

[22] Filed: Mar. 4, 1999

Related U.S. Application Data

[60] Provisional application No. 60/076,768, Mar. 4, 1998.

[51] Int. Cl.[7] ..... A41C 3/00

[52] U.S. Cl. ..... 450/39; 450/57

[58] Field of Search ..... 450/39, 53–57, 450/65, 66, 70, 1; 2/455, 456, 463, 267, 92

[56] References Cited

U.S. PATENT DOCUMENTS

| | | | |
|---|---|---|---|
| 2,579,365 | 12/1951 | Condé | 450/57 |
| 2,896,623 | 7/1959 | Fitzgerald | 450/57 |
| 3,176,686 | 4/1965 | Barnes | 450/57 |
| 4,566,458 | 1/1986 | Weinberg | 450/57 |
| 4,607,640 | 8/1986 | McCusker | 450/57 |
| 5,022,887 | 6/1991 | Lawson | 450/54 |
| 5,032,103 | 7/1991 | Larsson | 450/37 |
| 5,439,409 | 8/1995 | McCracken et al. | 450/31 |
| 5,769,688 | 6/1998 | Holliday | 450/57 |
| 5,806,103 | 9/1998 | McCracken et al. | 2/455 |

*Primary Examiner*—Gloria Hale
*Attorney, Agent, or Firm*—Daniel V. Thompson

[57] ABSTRACT

A sports bra includes interchangeable breast protectors of varying degrees of protection. A breast protector for a sports bra with walls defining nipple recesses. A breast protector for a sports bra with a soft, flexible foam section and a hard plastic armor layer. A gap between inner and outer layers of the sports bra is sized to permit the insertion and removal of the breast protectors and retention of the breast protectors between the inner and outer layers.

1 Claim, 4 Drawing Sheets

SPORTS BRA

This application claims benefit to U.S. provisional application Ser. No. 60/076,768 filed Mar. 4, 1998.

TECHNICAL FIELD

The present invention relates to athletic apparel, and more particularly to women's upper torso garment having armored cups.

BACKGROUND ART

The state of the art in sports bras is the so-called "jog bra" familiar to women engaged in sporting activities. With boxing for women gaining acceptance as a sports activity, it has become apparent that a sports bra offering improved protection is needed.

McCracken et al. disclose breast protectors having a demi-teardrop shape in U.S. Pat. Nos. 5,806,103 and 5,439,409. The McCracken et al. breast protectors are intended to be used with a conventional brassiere.

SUMMARY OF THE DISCLOSURE

This invention provides an improved sports bra that has interchangeable cups, so that the degree of protection is variable. In another aspect of the invention the cups are formed with nipple recesses for improved fit and comfort.

BRIEF DESCRIPTION OF THE DRAWINGS

A more complete understanding of the invention and its advantages will be apparent from the Detailed Description taken in conjunction with the accompanying Drawings, in which.

DETAILED DESCRIPTION OF THE PREFERRED EMBODIMENT

Figure 1:
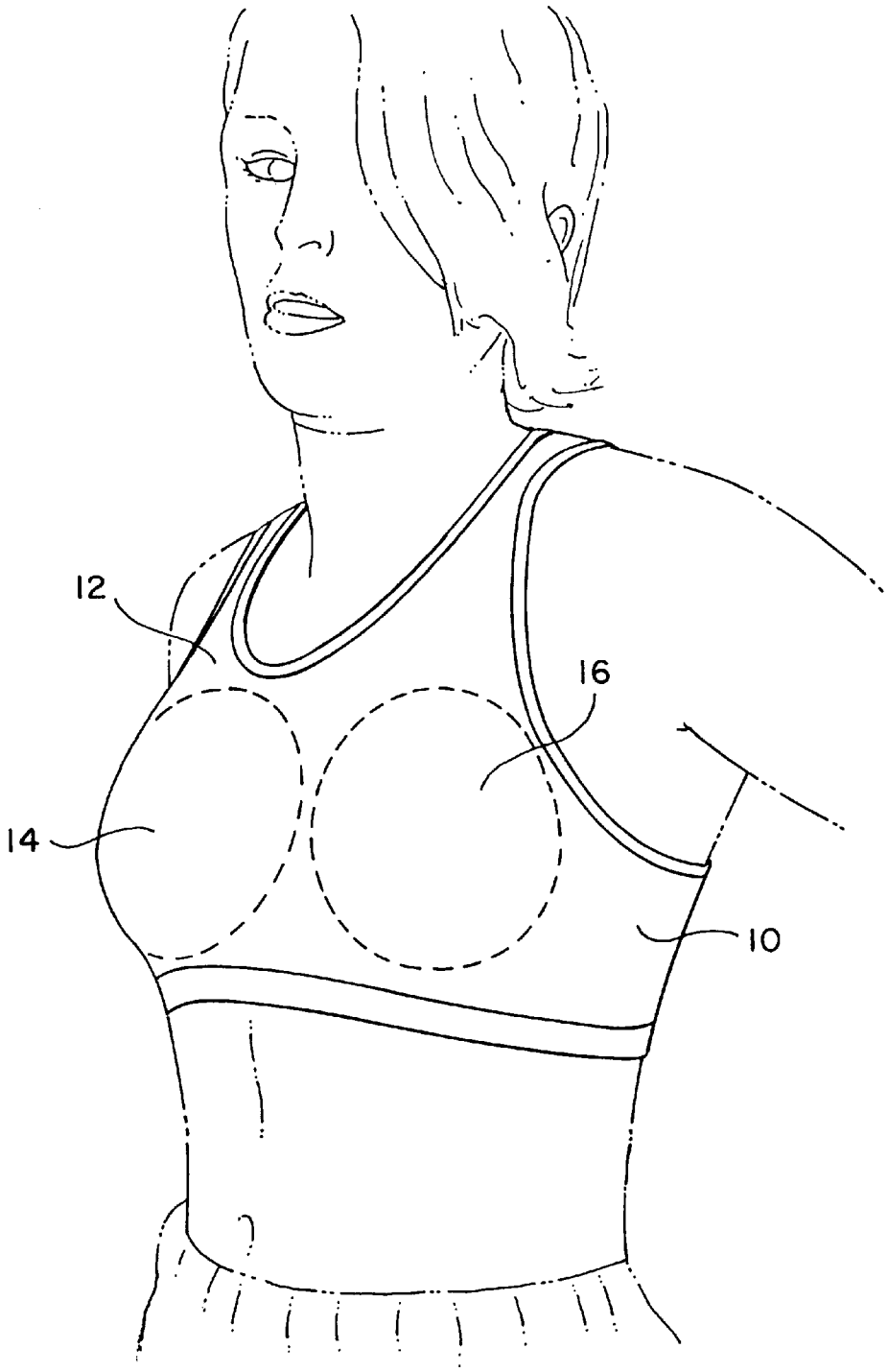
FIG. 1 is a perspective view of our new sports bra.

Referring initially to FIG. 1, sports bra 10 has a textile main garment 12. Main garment 12 has breast protectors 14, 16 within. Breast protectors 14, 16 may optionally be selected from one of several types of protection, depending on the activity in which they are used.

Figure 2:
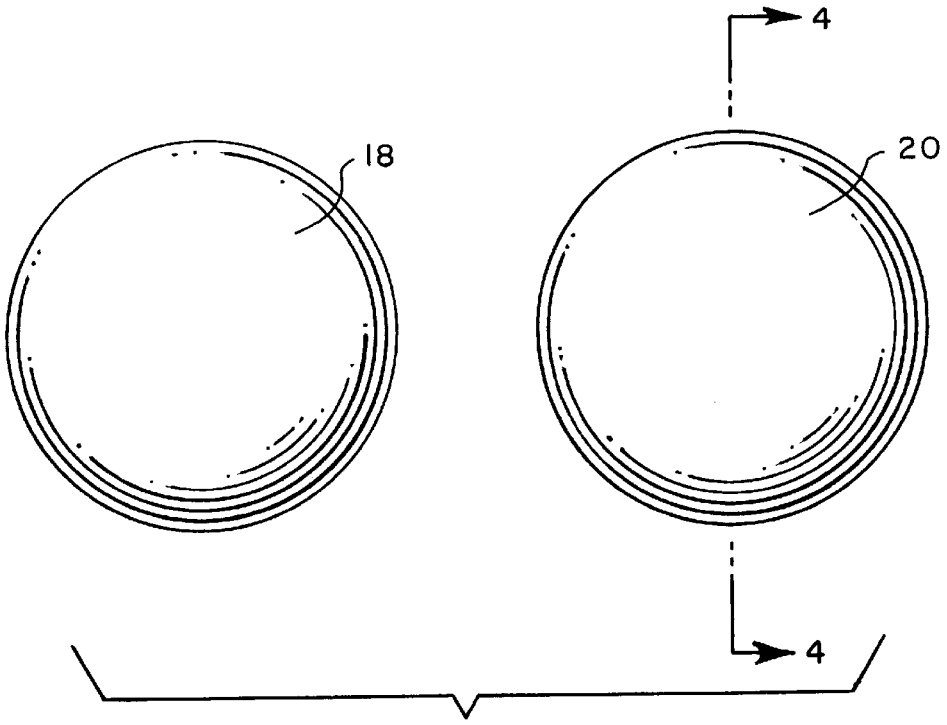
FIG. 2 is a front view of a first set of interchangeable cups.
Figure 3:
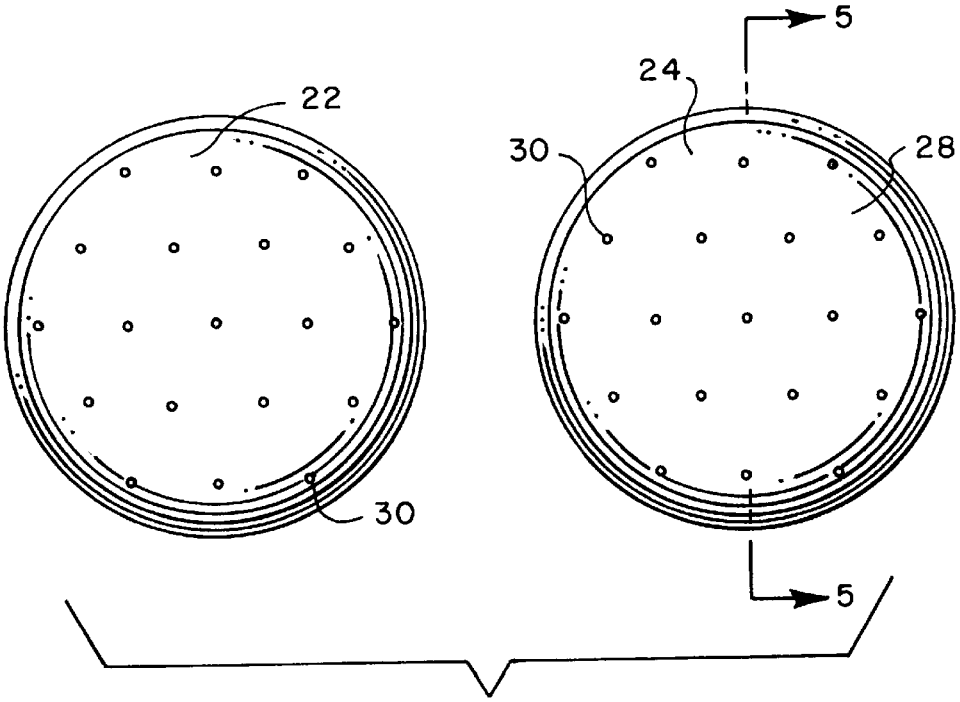
FIG. 3 is a front view of a second set of interchangeable cups.
Figure 4:
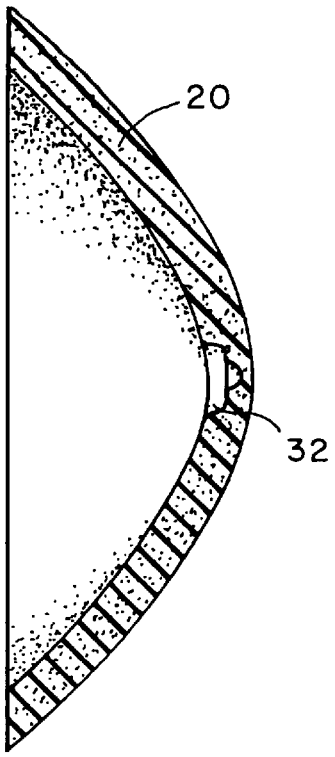
FIG. 4 is a sectional view taken along lines 4—4 of FIG. 2.
Figure 5:
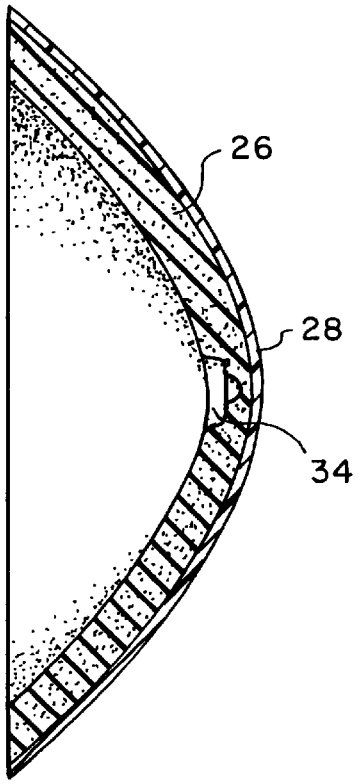
FIG. 5 is a sectional view taken along lines 5—5 of FIG. 3.

In FIGS. 2 and 4, first interchangeable cups 18, 20 are made entirely of soft, flexible foam 22. In FIG.s 3 and 5, second interchangeable cups 22, 24 have a soft, flexible foam section 26 and a hard styrene armor layer 28. Armor layer 28 is pierced with holes 30 to promote breathability. First interchangeable cups 18, 20 include nipple recesses 32, and second interchangeable cups 22, 24 include nipple recesses 34.

Figure 6:
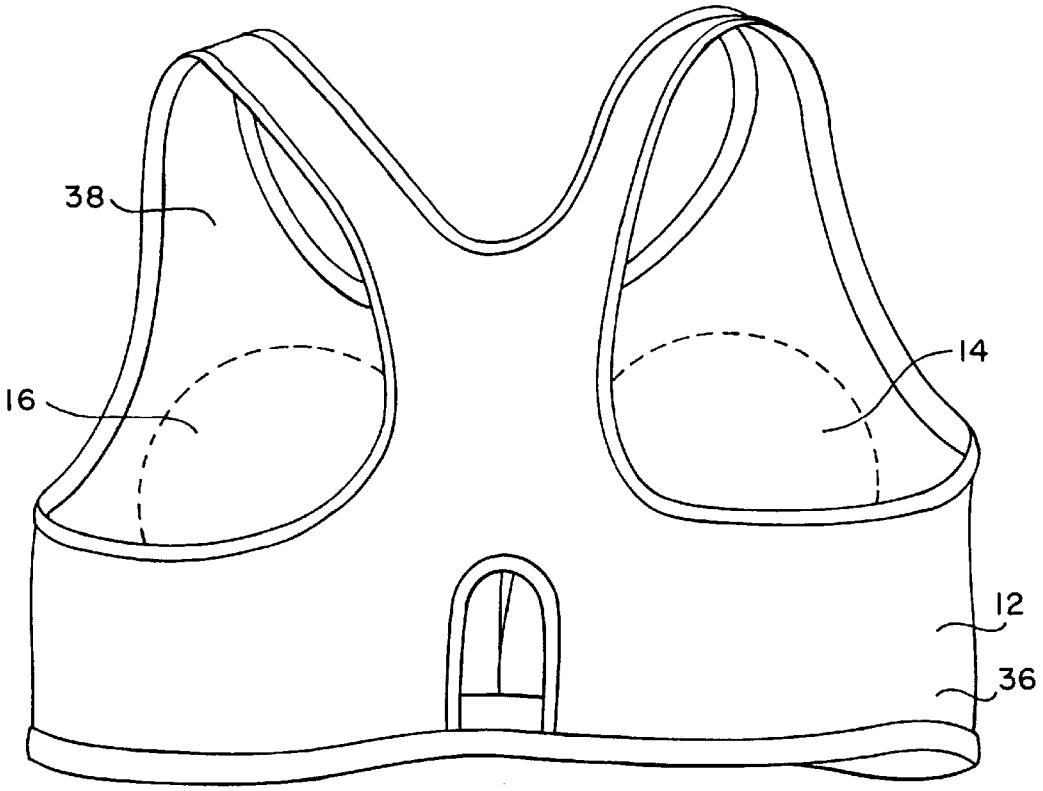
FIG. 6 is a front elevational view of the sports bra.
Figure 7:
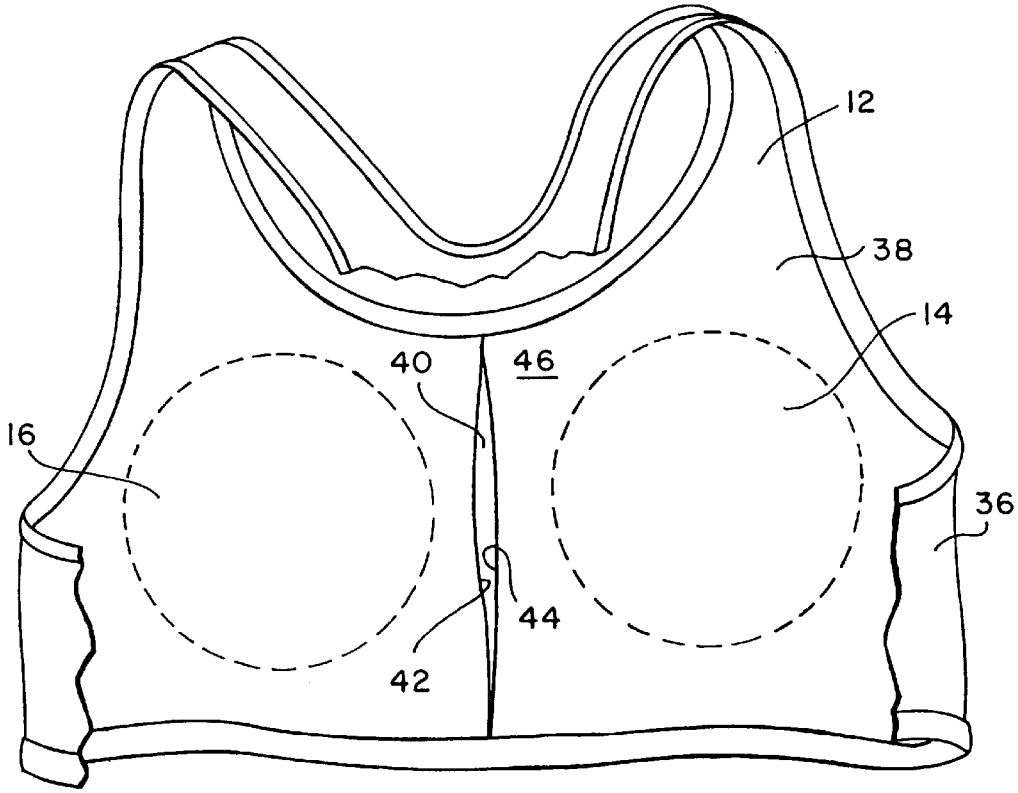
FIG. 7 is a partially broken away front elevational view of the sports bra.

Referring now to FIGS. 6 and 7, main garment 12 is preferably formed of an outer layer 36 of stretchable cotton-poly fabric and an inner layer 38 of wicking poly Lycra fabric. The overall shape of the garment 12 is that of the conventional jog bra, except that a gap 40 is formed by opposed edges 42, 44 in the front, center portion 46 of inner layer 38. Gap 40 is sized to permit the insertion and removal of breast protectors 14, 16 and retention of the breast protectors 14, 16 between the inner and outer layers 38, 36.

The wearer can select either of the interchangeable cups sets depending on the nature of the sports activity she will engage in, or no cups at all for non-impact sports. The cups are designed for easy insertion and removal and to provide a smooth and comfortable fit. The foam-only cups 18, 20 provide adequate protection for such activities as basketball, soccer, flag football, volleyball, cycling and jogging. For boxing and other impact sports the armored cups 22, 24 would be selected.

The sports bra of this invention offers protection, comfort, flexibility and durability.

Whereas, the present invention has been described with respect to a specific embodiment thereof, it will be understood that various changes and modifications will be suggested to one skilled in the art, and it is intended to encompass such changes and modifications as fall within the scope of the appended claim.

We claim:

1. A sports bra, comprising:

a textile main garment having breast protectors;

the breast protectors chosen from a pair of first interchangeable cups made entirely of soft, flexible foam and a second pair of interchangeable cups having a soft, flexible foam section and a hard plastic armor layer;

with the armor layer pierced with holes to promote breathability;

the breast protectors including nipple recesses;

the main garment formed of an outer layer and an inner layer, with a gap formed by opposed edges in a front, center portion of the inner layer, and the gap sized to permit the insertion and removal of the breast protectors and retention of the breast protectors between the inner and outer layers.

* * * * *